US009905356B2

(12) United States Patent
Young

(10) Patent No.: US 9,905,356 B2
(45) Date of Patent: Feb. 27, 2018

(54) MAGNETIC COMPONENT FOR A SWITCHING POWER SUPPLY AND A METHOD OF MANUFACTURING A MAGNETIC COMPONENT

(71) Applicant: Eisergy Limited, Dublin (IE)

(72) Inventor: George Young, Dublin (IE)

(73) Assignee: Icergi Limited, Dublin (IE)

( * ) Notice: Subject to any disclaimer, the term of this patent is extended or adjusted under 35 U.S.C. 154(b) by 0 days.

(21) Appl. No.: 14/777,015

(22) PCT Filed: Mar. 14, 2014

(86) PCT No.: PCT/EP2014/055212

§ 371 (c)(1),
(2) Date: Sep. 15, 2015

(87) PCT Pub. No.: WO2014/140349

PCT Pub. Date: Sep. 18, 2014

(65) Prior Publication Data

US 2016/0049238 A1 Feb. 18, 2016

(30) Foreign Application Priority Data

Mar. 15, 2013 (GB) ..... 1304719.6

(51) Int. Cl.
*H01F 27/30* (2006.01)
*H01F 17/06* (2006.01)
(Continued)

(52) U.S. Cl.
CPC ..... *H01F 27/325* (2013.01); *H01F 3/14* (2013.01); *H01F 27/24* (2013.01); *H01F 27/263* (2013.01)

(58) Field of Classification Search
CPC ..... H01F 27/325; H01F 27/24; H01F 27/263; H01F 27/245; H01F 27/29; H01F 27/292;
(Continued)

(56) References Cited

U.S. PATENT DOCUMENTS 2,909,742 A * 10/1959 Lamberton ..... H01F 27/25 336/210
3,480,229 A * 11/1969 Entremont ..... H01F 5/02 242/118.4
(Continued)

FOREIGN PATENT DOCUMENTS

EP 1519392 A1 3/2005
GB 1562276 A 3/1980
(Continued)

OTHER PUBLICATIONS

"PCT Search Report/Written Opinion for related PCT/EP2014/055212 application, dated Jun. 4, 2014, 14 pages".

*Primary Examiner* — Mangtin Lian
(74) *Attorney, Agent, or Firm* — Charles A. Lemaire; Jonathan M. Rixen; Lemaire Patent Law Firm, P.L.L.C.

(57) ABSTRACT

The present application relates to magnetic components employed in switching power supplies. The application provides a gapped magnetic core (20) construction in which the gap is distributed by placing gaps between the legs (23) of the core and the top and bottom sections (21, 22). The application also provides a bobbin construction having a reduced footprint for inductor and transformers.

20 Claims, 11 Drawing Sheets

(51) Int. Cl.

| | |
|---|---|
| ***H01F 27/24*** | (2006.01) |
| ***H01F 17/04*** | (2006.01) |
| ***H01F 27/32*** | (2006.01) |
| ***H01F 3/14*** | (2006.01) |
| ***H01F 27/26*** | (2006.01) |

(58) Field of Classification Search

CPC ..... H01F 3/14; H01F 5/02; H01F 5/04; H01F 2005/022; H01F 2005/025; H01F 2005/043; H01F 2005/046; H01F 2027/297

USPC ..... 336/198, 208, 192, 178, 212

See application file for complete search history.

(56) References Cited

U.S. PATENT DOCUMENTS

| | | | | |
|---|---|---|---|---|
| 3,559,128 | A * | 1/1971 | Kingston | H01F 6/00 335/216 |
| 4,200,853 | A * | 4/1980 | de Jong | H01F 27/306 336/192 |
| 4,716,394 | A * | 12/1987 | Gordon | H01F 27/306 242/118.41 |
| 5,773,724 | A | 6/1998 | Unterseh | |
| 5,889,450 | A | 3/1999 | Kim et al. | |
| 5,977,855 | A * | 11/1999 | Matsumura | H01F 27/365 336/192 |
| 6,046,663 | A | 4/2000 | Kubomura et al. | |
| 6,208,232 | B1 * | 3/2001 | Chen | H01F 27/292 336/107 |
| 6,507,261 | B1 * | 1/2003 | Haga | H01F 38/30 336/192 |
| 6,646,536 | B2 | 11/2003 | Mori | |
| 7,236,077 | B1 | 6/2007 | Hsu | |
| 7,378,932 | B1 | 5/2008 | Crow et al. | |
| 8,054,152 | B2 | 11/2011 | Tseng et al. | |
| 8,245,580 | B2 | 8/2012 | Rogers | |
| 8,698,587 | B2 | 4/2014 | Park et al. | |
| 2002/0011914 | A1 * | 1/2002 | Ikeura | H01F 27/325 336/208 |
| 2002/0149458 | A1 * | 10/2002 | Fujiwara | H01F 1/0552 336/110 |
| 2004/0085173 | A1 * | 5/2004 | Decristofaro | H01F 27/245 336/178 |
| 2008/0100407 | A1 * | 5/2008 | Yamaguchi | H01F 5/04 336/192 |
| 2011/0254651 | A1 * | 10/2011 | Won | H01F 27/22 336/220 |
| 2012/0001714 | A1 * | 1/2012 | Shin | H01F 27/30 336/198 |
| 2012/0161913 | A1 * | 6/2012 | Yen | H01F 27/025 336/199 |
| 2013/0002386 | A1 * | 1/2013 | Park | H01F 27/2828 336/192 |

FOREIGN PATENT DOCUMENTS

| | | | |
|---|---|---|---|
| JP | 2004 247478 | A | 9/2004 |
| JP | 2006 135018 | A | 5/2006 |
| JP | 2007-173628 | A | 7/2007 |
| SU | 101151 | A1 | 11/1954 |
| WO | WO 2009053534 | A1 | 4/2009 |

* cited by examiner

PRIOR ART

Figure 12
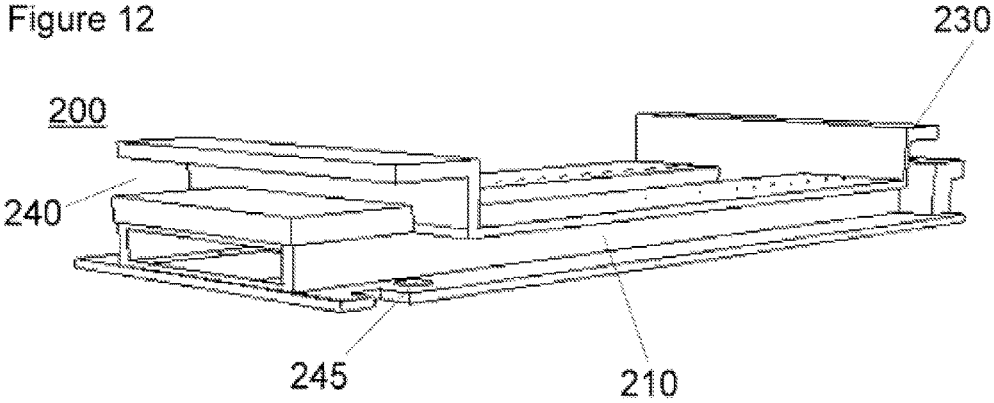
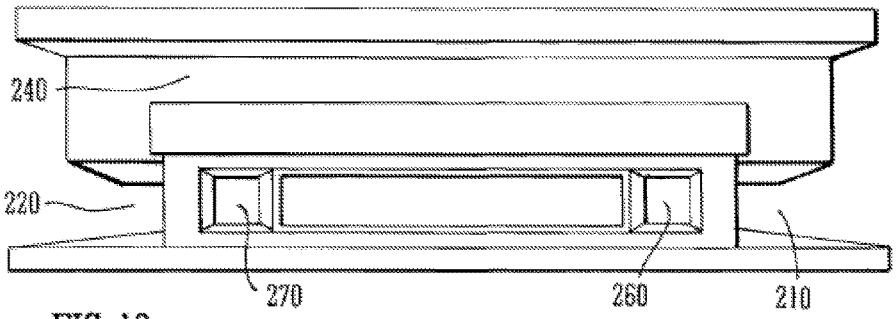
FIG. 13
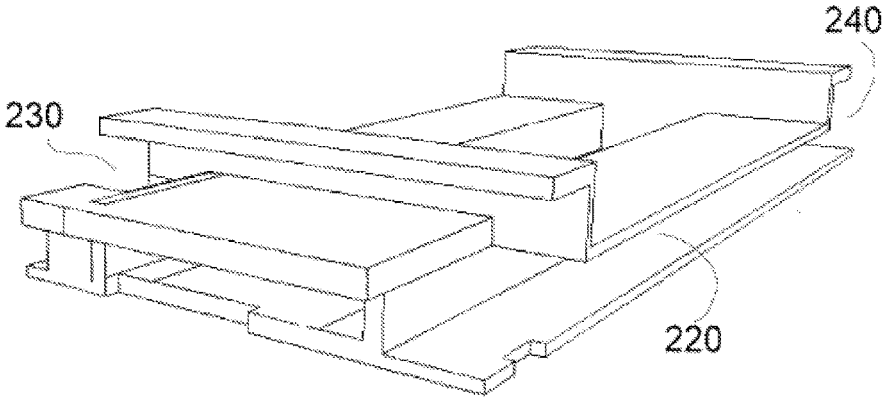
Figure 14

MAGNETIC COMPONENT FOR A SWITCHING POWER SUPPLY AND A METHOD OF MANUFACTURING A MAGNETIC COMPONENT

FIELD

The present application relates to magnetic components employed in switching power supplies.

BACKGROUND

Magnetic components are used in switching power supplies for the storage of electrical energy in a magnetic field. Magnetic components comprise an electrical part (windings) and a magnetic core. Where there is just one winding, the magnetic component is an inductor and where there is more than one winding the magnetic component is generally a transformer.

A magnetic core is a piece of magnetic material with a high permeability used to confine and guide magnetic fields in electromagnetic devices such as transformers and inductors. Magnetic cores are typically made from a ferromagnetic such as ferrites. The high permeability, relative to the surrounding air, causes the magnetic field lines to be concentrated in the core material. The magnetic field is created by a coil of wire around the core that carries a current. The presence of the core can increase the magnetic field of a coil by a factor of several thousand over what it would be without the core.

The use of a magnetic core can enormously concentrate the strength and increase the effect of magnetic fields produced by electric currents. The properties of a device will depend on a number of factors including for example the geometry of the magnetic core, the amount of air gap in the magnetic circuit and the properties of the core material.

Depending on the application, a variety of different magnetic core shapes are available. One or more electrical windings are wound around one or more sections of the core. A bobbin may be used to form and retain the windings. Bobbins are typically formed from an insulating material such as plastic.

There are a variety of different core shapes known, for example: open core shapes, including "I", "C" "E" and "U" cores which are so called because of their corresponding cross sectional shape; and closed core shapes, which may be formed by combining such open core shapes together.

The present application is directed to applications where the power supply is supplying of the order of less than 300 Watts. In such applications, the power supply may be housed in an adapter of the type which would be familiar to most laptop users. In such applications, minimising the size\weight of the power supply is generally desirable. At the same time because of the mass production nature of these supplies, using readily available core components is desirable for both cost and manufacturability.

To this end, in the context of such core components, the most common approach is to select an E-shaped core section are generally selected to form a closed magnetic core using either a second "E" shaped section or an "I" shaped section with the electric circuit wound around the resulting centre leg. The E-section core tends to be the most common type of core employed due to its shielding properties and the ability to support the structure mechanically.

A number of variations on the general E shaped cores are known including pot cores and EFD, ER and EP cores. For example, a pot core may be viewed as having a generally "E" shaped cross section albeit that it has been rotated somewhat to further enclose the centre leg between the outer legs.

Whilst the magnetic core is one part of the magnetic component, an equally important part is the electrical part. The electrical part provides conductive elements which form turns around the magnetic material referred to generally as windings. These windings may be in the form of stampings, rigid or flexible printed circuit boards or wound wire (on bobbins, or self-supporting). Optimising the winding structure is important in the context of getting best performance from the magnetic component. It will be appreciated that the definition of best performance will vary depending on the application and will generally involve a trade-off between different characteristics. For example, depending on the application, it may be desirable to minimise leakage inductance. Equally in other applications it may be desirable to have increased leakage inductance. For example, with switching power supplies, of the type to which the present application is directed, it is generally desirable to have compact magnetic components and low losses. At the same time there can be conflicting demands. For example, for a transformer employed in a mains powered switching power supply it is essential that sufficient isolation be provided between primary and secondary windings. It will be appreciated that magnetic components employed in switching power supplies are not generally comparable with those used for general AC transformer applications, i.e. mains frequencies of 50/60 Hz. Switching power supplies generally operate at frequencies above audio frequencies, i.e. above 20 kHz and so would have entirely different design characteristics. Thus, whilst iron laminate cores may be common in mains (non-switched) transformers, similar iron laminate cores (i.e. laminate cores having a thickness suited for use in mains transformers) would be considered entirely unsuitable in a switched power supply.

Thus in switching power supplies, the cores selected for magnetic components are generally formed from a suitable ferrite material. Most ferrites used for cores in switching power supply deployments have a relative permeability ($\mu_r$) in the order of 500 or more. Low effective permeability is desired in many magnetic components, and accordingly in the case of ferrite materials, it is usual to introduce a gap in the magnetic path through the ferrite material.

There is a number of ways of forming air gaps with three legged cores using "E" shaped cores. For example, in FIG. 1 (*a*) a magnetic component 10A is provided with three air gaps formed by assembling an "E" core 11 and an "I" core 12 with a gap there between, thereby leaving air gaps between the "I" core and each leg of the "E" core 11, or as shown in FIG. 1(*b*) by assembling two "E" cores 11 with a gap there between to provide the core 10B.

However, the conventional solution in providing an "air" gap, as shown in the core 10C of FIG. 1(*c*) is to shorten the centre leg of a first "E" core 11*a* and to assemble this in combination with a second "E" core 11*b*. In this manner, the air gap sits in the middle of the coil which in turn would typically is wound around the centre leg, i.e. there is no gap in the outer legs. This is done so as to minimise fringing and reduce electromagnetic interference. The term "air" gap is generally used to refer to any gapped core as such even though the gap may not be filled by air but by nylon or some other non-saturable material (non-saturable being relative to the magnetic material used in the core).

Less conventionally, an "E" core 11*a* with a shortened leg might be combined with an "I" core 12 to provide a core 10D as shown in FIG. 1(*d*). Magnetic cores are however fragile and grinding operations to shorten a leg can produce an unreliable gap length, whilst at the same time introducing a step in the manufacturing process. Although cores prefabricated with a shortened leg are known, it will be appreciated that this limits the component designer's freedom to meet particular design objectives.

A further problem with the conventional approach of FIG. 1(*c*) is that a large fringe-field area exists which can cause significant loss in the conductive materials. This effect may be ameliorated somewhat using Litz-wire in windings, or by techniques involving the interchange of strands in printed-wire conductors. However, Litz windings whilst desirable for losses introduce other problems, for example the limited availability of adequate insulation to ensure isolation between primary and secondary windings. Nonetheless, even where Litz wire is employed considerable increases in AC-resistance can still occur due to presence of the air-gap. Recommended industry practice can be to keep wiring away from the gap, with the distance typically being several times the gap length. This creates difficulties and requires careful arrangement of the windings, which it will be appreciated, can complicate the designing of the winding arrangements.

The present application seeks to address one or more of the shortcomings set forth above and to provide a magnetic component which is suitable for use in a compact switching power supply where the power converted is of the order of less than 300 Watts.

SUMMARY

Accordingly, the present application provides a method of assembling a gapped magnetic component from sections of magnetic material and a gapped magnetic component in accordance with the claims which follow. Further advantageous embodiments are provided in the dependent claims. The application also provides a novel bobbin construction.

A first embodiment provides a method of assembling a closed three legged gapped magnetic component, which is either an inductor or a transformer. The component comprises sections of magnetic material namely three legs, a top and a bottom section. The method comprises the steps of:

a) applying an adhesive to a first area of a surface of a first magnetic section;

b) providing a first spacer on a second area of the surface, where said first and second areas are distinct;

c) applying a second section of magnetic material toward the surface of the first magnetic section such that the first and second sections become adhered by the adhesive with the thickness of the adhesive defined by the spacer. These steps are repeated such that at least one spacer is provided between each leg and the top section and at least one spacer is provided between each leg and the bottom section. The method results in an assembled magnetic component having an overall height of less than 20 mm. The footprint of the top or bottom section may be greater than that of the three legs. The thickness of the first spacer may be between 10 μm and 200 μm. Potentially, more than one spacer is provided between the first and second magnetic sections.

Suitably, an electrical winding is provided about the first magnetic section.

This winding may be provided on a bobbin.

A further embodiment provides a closed three legged magnetic component for use in a switching power supply and is thus either a transformer or an inductor. The component comprises a top section, a bottom section and three individual leg sections. A gap provided between each leg section and the top section and a gap provided between each leg section and the bottom section. The gap length is defined by a spacer. An adhesive is employed in each gap to adhere the leg sections to the top and bottom sections. The adhesive is not applied to the spacer. The height of the magnetic component is desirably less than 2 cm. The footprint of the top or bottom section may be greater than the footprint of the leg sections. The thickness of each gap has a gap length of between 10 μm and 200 μm.

The magnetic component may include a bobbin. The bobbin in turn may comprise an inner wall defining an opening for receiving the leg of the magnetic component, a first longitudinal channel for receiving a first section of a first winding, a second longitudinal channel for receiving a second section of the first winding, wherein the first longitudinal channel and the second longitudinal channel are coplanar and on opposite sides of the opening, a transverse path for receiving an intermediate section of the first winding joining the first and second sections, wherein the transverse path is in a different plane to that of the first and second longitudinal channels.

The bobbin may further comprise a first longitudinal passage provided between the inner wall and the first longitudinal channel, a second longitudinal passage provided between the inner wall and the second longitudinal channel, wherein the first and second passages are provided to receive a second winding. The first and second longitudinal passages and first and second channels may be substantially coplanar.

The bobbin may further comprise a second opening provided at one end to a transverse passage path between the first and second longitudinal passages to allow the first winding to be fed from the first longitudinal passage to the second longitudinal passage. The transverse passage path is suitably recessed from the second opening.

Where the magnetic component is a transformer, it may comprise the first winding and the second winding. The diameter of each of the first and second longitudinal passages is at least 20% more than the diameter of the second winding.

A spacer may be provided to maintain the second winding in a predefined position in one of the passages. The second winding may comprises a single turn.

The bobbin may provide first and second concentric paths for first and second windings respectively about an opening where the first and second concentric paths are isolated from each other, the bobbin providing openings at opposing ends of the bobbin to allow feeding of the first winding about the first concentric path.

In a further embodiment a bobbin is provided. This bobbin may be used with any three legged magnetic core for the construction of a transformer or an inductor for use as an energy storage element in a switching power supply. The bobbin suitably comprises an inner wall defining an opening for receiving the leg of a magnetic component, a first longitudinal channel for receiving a first section of a first winding, a second longitudinal channel for receiving a second section of the first winding, wherein the first longitudinal channel and the second longitudinal channel are coplanar and on opposite sides of the opening, a transverse path for receiving an intermediate section of the first winding joining the first and second sections, wherein the transverse path is in a different plane to that of the first and second longitudinal channels.

The bobbin suitably comprises a first longitudinal passage provided between the inner wall and the first longitudinal channel. A second longitudinal passage may then be situated between the inner wall and the second longitudinal channel.

These first and second passages are provided to receive a second winding. Thus the bobbin may be used to provide transformer windings.

The first and second longitudinal passages and first and second channels are suitably substantially coplanar. The bobbin may further comprise an opening provided at one end to a transverse passage path between the first and second longitudinal passages to allow a winding to be fed from the first longitudinal passage to the second longitudinal passage. To provide for greater creepage, the transverse passage path may be recessed from the opening.

Where the bobbin is used for a transformer with first and second windings on the bobbin, the diameters of first and second longitudinal passages may be at least 20% more than the diameter of the second winding. This is to allow space to feed the windings.

To ensure that the construction is consistent and leakage inductance/capacitance values are consistent, a spacer (for example reference number 299 on FIG. 15*e*) may be provided to maintain the second winding in a predefined position in one of the passages.

Advantageously, the second winding may comprise a single turn. This is particularly the case where higher switching frequencies are employed. In a further embodiment, a magnetic component is provided for a switching power supply, the magnetic component has a top section and a bottom section separated by three legs of magnetic material. Each of the top and bottom sections and of the three legs are single laminar pieces of magnetic material.

Gaps are provided between each of the three legs and each of the top and bottom sections.

A further embodiment provides a single piece bobbin formed from a plastics material for a magnetic component, the bobbin providing first and second concentric paths for first and second windings respectively about an opening where the first and second concentric paths are isolated from each other, where the first and second concentric paths are co-planar about a longitudinal axis and where the second path is splayed away from the plane on a transverse axis to provide access to openings in the bobbin providing at opposing ends of the bobbin to allow feeding of the first winding about the first concentric path.

Other features and advantages of the present application will become apparent from the following description of the application which refers to the accompanying drawings.

In yet another embodiment, a single piece split bobbin is provided having an inner wall defining a core opening into which a magnetic core may be received.

A first region is provided around the inner wall. The first region is open to allow a first winding to be wound around the inner wall. A separating wall separates the first region from a second region. The separating wall extends outward from and is transverse to the inner wall. The second region is at least partially enclosed by one or more outer walls concentric to the inner wall. The outer walls isolate and provided enhanced creepage between a winding in the second region and any surrounding magnetic core material. Openings are provided at opposing sides of the bobbin where there is to be no magnetic core material to allow a second winding to be fed through from one side to the other and back again. A top wall may be provided parallel to the separating wall to define with the inner wall, the first region. A bottom wall may be provided on the opposite end of the bobbin to the separating wall. The bottom wall, with the inner walls, outer walls and separating wall defines the second region.

It will be appreciated that as the second region is enclosed, a winding may not be wound directly about the inner wall in the second region and the openings must instead be employed to feed the winding about the inner wall.

BRIEF DESCRIPTION OF THE DRAWINGS

The present application will now be described with reference to the accompanying drawings in which:

FIG. 12 is a first view of a bobbin for a magnetic component according to a further aspect of the present application;

FIG. 13 is another view of the bobbin of FIG. 12;

FIG. 14 is another view of the bobbin of FIG. 12;

DETAILED DESCRIPTION OF THE DRAWINGS

The present application provides a magnetic component which is suitable for use in a switching power supply. The type of magnetic component may be an inductor or a transformer. The magnetic component is intended for use in a switching power supply having a switching frequency of at least 20 kHz. The size of the component is such that the power being converted would be less than 300 Watts. The nature of the magnetic component is such that it would be placed directly as a component on the circuit board of the switching power supply. The magnetic component suitably therefore is of a size that allows for it to be provided directly onto a circuit board. A general requirement for such applications is that the magnetic component has a relatively low profile.

The magnetic component has a core comprising three legs. The core is suitably formed from ferrite materials. The core is gapped. In contrast, to the conventional approach with an E-core, the gap is distributed such that each of the legs are individually gapped. Each of the gapped legs has multiple gaps.

Figure 1:
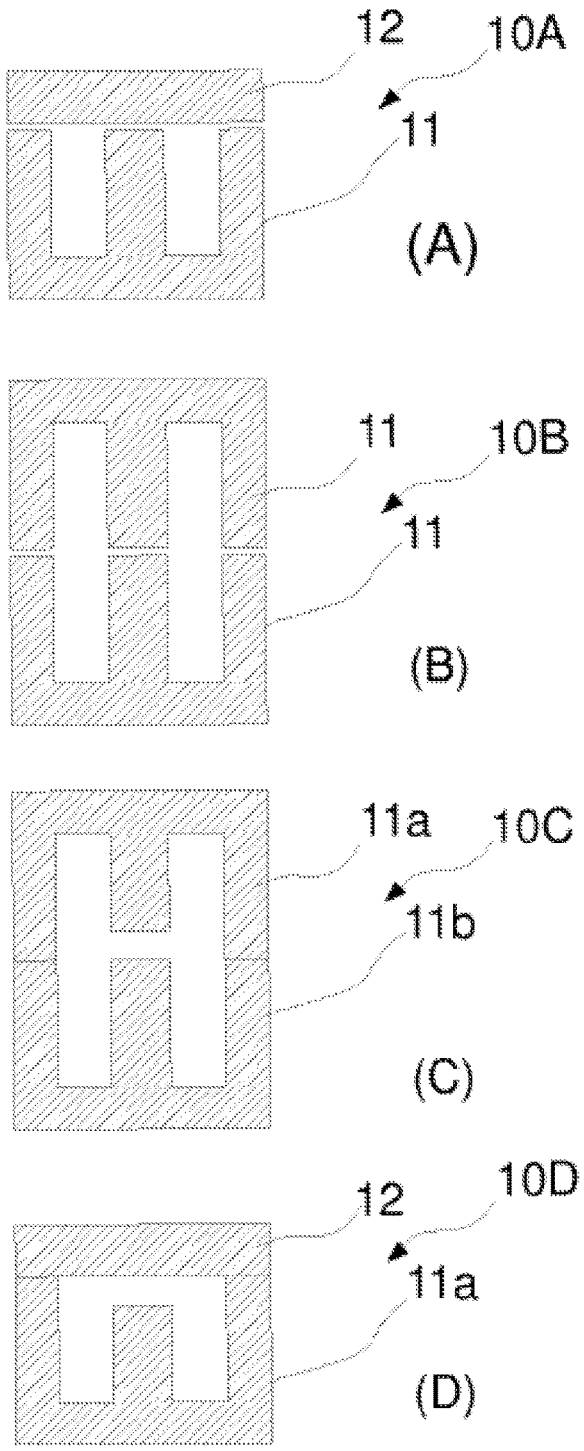
FIG. 1 illustrates examples of prior art gapped magnetic components.
Figure 2:
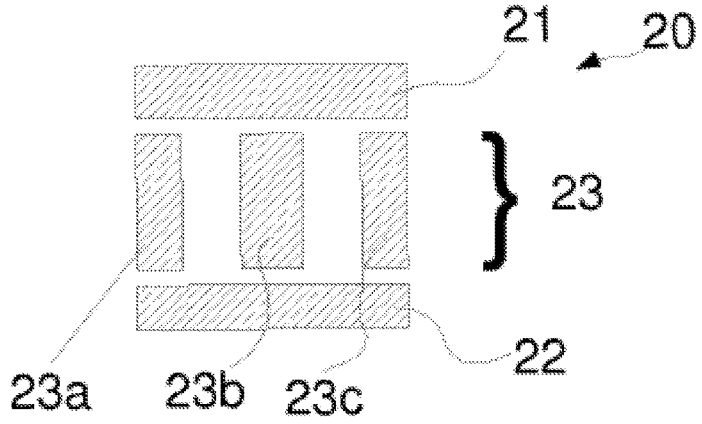
FIG. 2 illustrates a side view of a gapped core for a magnetic component according to a first aspect of the present application.

Referring to the exemplary structure of FIG. 2, a three legged gapped magnetic core 20 is provided. The core 20 may be used in combination with electrical windings to provide a magnetic component, for example an inductor or a transformer. The gapped magnetic core 20 comprises a top section 21 and a bottom sec*b*, 23*c*. The top 21 and bottom 22 sections may be plates of ferrite material. The gap in the core 20 is provided by a combination of six individual gaps. More particularly, there are two gaps provided in each of the legs 23 of the three legged magnetic core 20. The first gap is provided between an individual leg 23 and the top section 21 and a second gap provided between the individual leg 23 and the bottom section 22. It will be appreciated that this structure means that the effective gap length of the core is four times the individual gap lengths (since the outer legs 23*a* and 23*c* are effectively in parallel magnetic paths), thus whilst there may be physically six gaps present in the transformer structure that in magnetic terms this is equivalent to just four. Thus the gap length requirement is a quarter that of the conventional structure of FIG. 1(*c*). At the same time, the structure is particularly well suited to lower-profile designs as typically required in switched power supplies.

Figure 5:
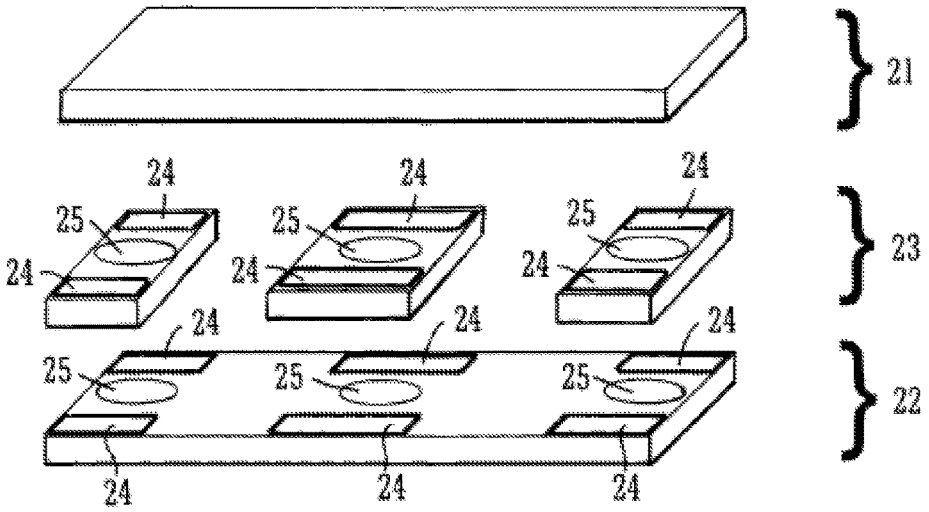
FIG. 5 illustrates a first method of assembling a gapped core of the type shown generally in FIGS. 2 to 4.
Figure 6:
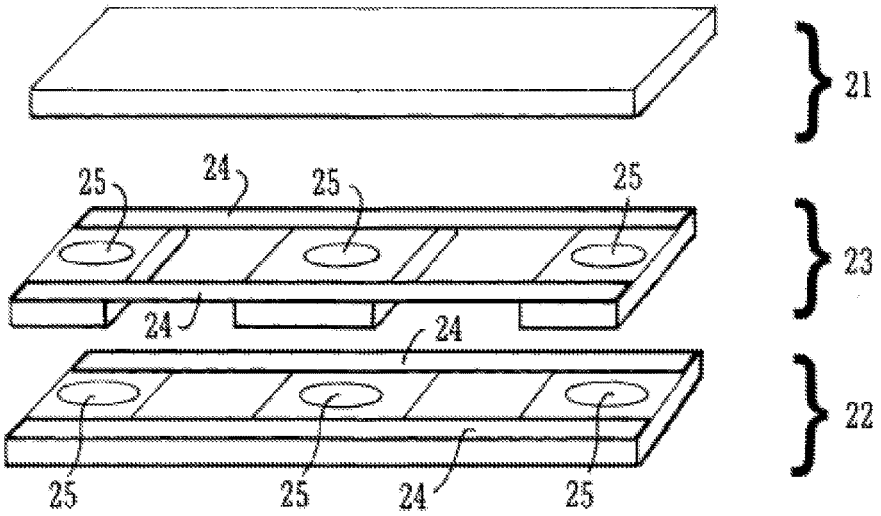
FIG. 6 illustrates a second method of assembling a gapped core of the type shown generally in FIGS. 2 to 4.

By reducing the gap by a factor of four, the fringe flux is reduced materially and likewise the "keepout zone" for wiring is reduced, typically to a level which is comparable to that generally presented by normal bobbin material thicknesses. Positioning the regions in proximity to the gaps in the corners also ensures that these are aligned perforce with regions where bobbin wall thickness is likely to be greatest thus ensuring maximum gap-winding separation. Whilst the exemplary structure employs six gaps, it will be appreciated that more may be provided by providing further gaps in the legs. For example, at least one further gap might be introduced in each leg 23, preferably mid-way along each leg 23. Although, it will be appreciated that this construction may be less than desirable as the overall height of the component would be increased and fringe flux would be introduced into regions where the windings would be present. Accordingly, the preferred implementation is where the gaps are provided only between the legs and top and bottom sections Where the magnetic component is intended for a switching power supply with a relatively high switching frequency, e.g. above 100 kHz, the necessity for large numbers of turns is significantly reduced and as a result, the height of the leg may correspondingly be reduced. An advantage of this is that the gapped core 20 may be formed from a number of separate laminar sections 21, 23, 22 as illustrated in FIGS. 5 and 6. Thus the laminar thickness of the top 21 section, bottom section 22 and legs 23 may advantageously all be the same allowing for ease of manufacture since a standard thickness of material may be used without a need for a thinning or similar process.

Figure 3:
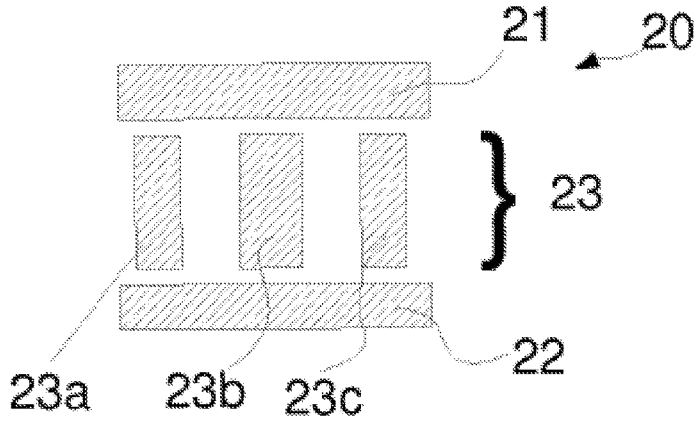
FIG. 3 is a side view of a gapped core according to a second aspect of the present application.
Figure 4:
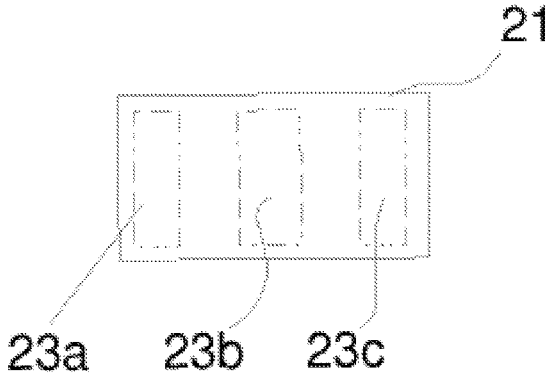
FIG. 4 is a top view of the gapped core of FIG. 3.

It will be appreciated that having the outside surfaces of the legs 23 flush with those of the top 21 and bottom 22 sections may allow excessive magnetic flux to be present outside the magnetic structure about the gaps. This problem may be reduced, as shown in FIGS. 3 and 4, by oversizing/overlapping the top 21 and bottom 22 sections relative to the legs. In this manner the footprint of the top 21 and bottom 22 sections extends beyond that occupied by the legs 23.

The sides of the core 20 may be wrapped with a ferrite polymer composite to reduce stray flux from the gaps if improved magnetic shielding is required. This is particularly useful for wrapping the core in the overlap instance presented between the legs and the top and bottom sections in FIG. 3 to constrain flux about the air gaps.

Figure 7:
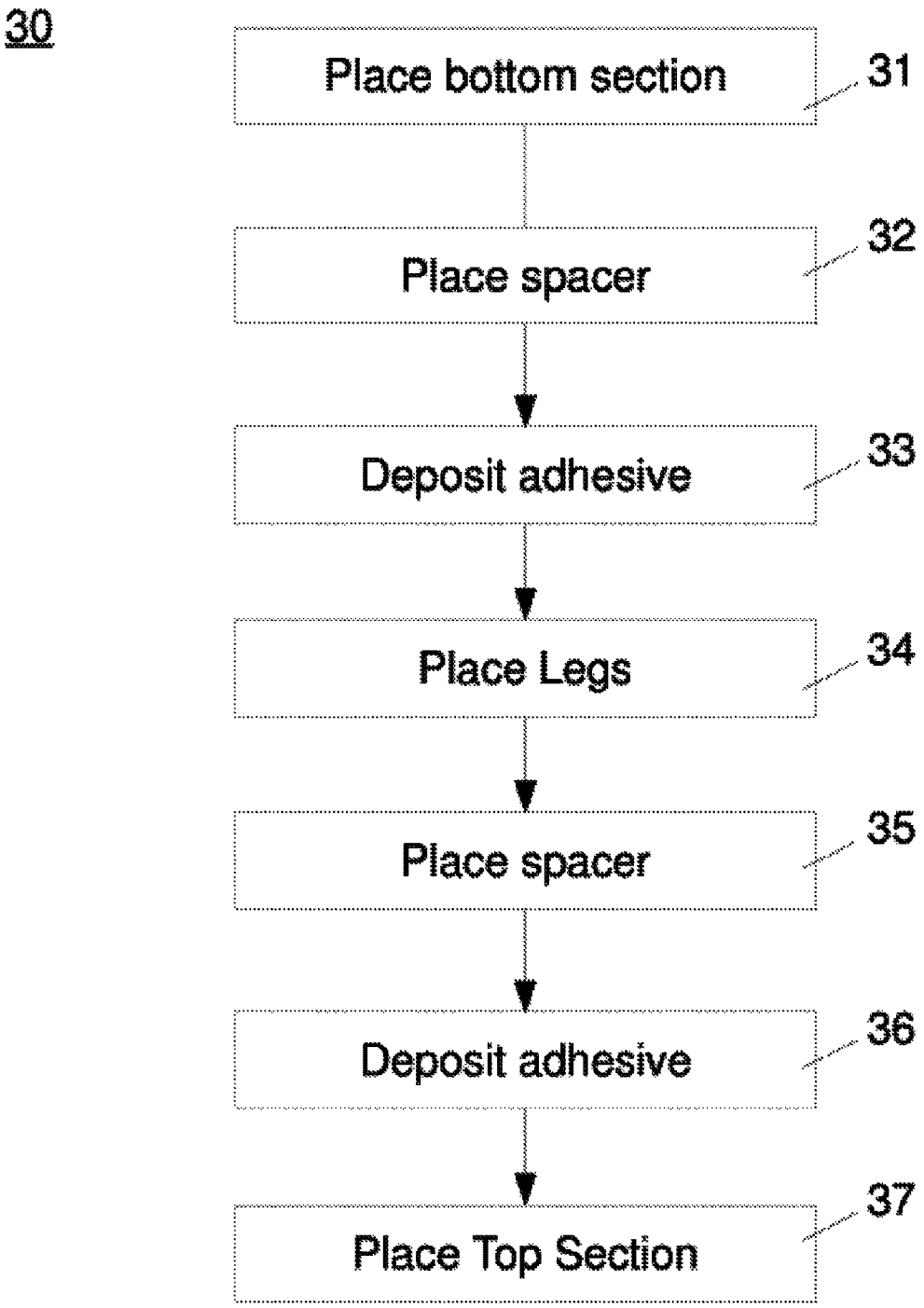
FIG. 7 is a process flow corresponding to the method of assembly of FIG. 5 or FIG. 6.

It will be appreciated that a plurality of gaps in the magnetic path greater than four may be used, and the number chosen will be a function of manufacturing issues as well as of the desire to maintain a uniform flux intersecting the winding. Operating at high frequencies, it is desirable that a reliable method of construction be employed to ensure the gap lengths are consistent and so as to ensure mechanical strength. The present application provides for a method of assembly 30, illustrated generally in FIGS. 5 and 6 and in the process flow of FIG. 7, which is simpler and generally suitable for mass production. For ease of illustration, the inclusion of an electrical part to the magnetic component has been omitted from the figures.

The core 20 is assembled using a plurality of individual sections 21, 22, 34 with the result that the core is relatively low profile. Suitably, low profile means the height of an assembled core 20 is less than 20 mm. Desirably, the height of the core is less than 10 mm. The sections 21, 22, 34 are formed from a suitable magnetic material. The magnetic material is suitably a ferrite. Exemplary materials include by way of example N49 from TDK-EPCOS and 3F35 from Ferroxcube. These materials are available in standard sizes having a length of 25 mm, a width of 18 mm and thickness of 2 mm. These pieces may be used for the individual sections or cut to size for individual sections where smaller pieces are required. It will be appreciated that other dimensions may be employed.

The method begins at step 31 with the placement of a bottom section 22. The bottom section is suitably laminar having a thickness of less than 5 mm. At the same time, the nature of the intended use is such that the length of the bottom section is suitably less than 40 mm. The width of the bottom section is suitably less than 25 mm. Thus for example one commercially available section has a length of 25 mm and a width of 18 mm with a thickness of 2 mm.

One or more spacer elements 24 are then placed upon the bottom section 22 in step 32. The purpose of the spacer element 24 is to define the gap length and thus the spacer thickness is selected to correspond to a desired gap length. The spacer element 24 is suitably a non saturable insulating material. An example generally of such a non saturable insulating material would be a plastic and a specific examples nylon or PTFE. It will be appreciated that the relative permeability of the insulating material should be low relative to that of the magnetic material. Suitably, the relative permeability of the insulating material is less than 5. In the arrangement of FIG. 5, two individual spacers are placed down on the bottom section for each leg. In this arrangement, the spacers are positioned on opposite sides leaving a space between them. In FIG. 6, two individual spacers are employed for all of the legs. More particularly, each of the spacers extends the length of the bottom section. For ease of assembly, the spacers may be formed as a single piece construction. Thus for example, the two individual spacers shown in FIG. 6 may be joined at either end. In this way, a single sheet of spacer material may be provided in which one or more cutouts may be provided to facilitate the placement of the adhesive 25. In some cases, the spacer may be implemented as sections of a bobbin assembly of the type generally described below. In this scenario, the necessary spacer functionality may be provided by partial "flaps" integrally formed with the bobbin. In other scenarios, the sheet of material or sections of material may be affixed to the bobbin. In all ways, having the spacer functionality provided as single sheet or integral to a bobbin makes assembly easier since the placement of the spacers may be performed in a single step. In one method of assembly, adhesive 25 is deposited as step 33 on the bottom section in regions where legs are to be placed but not where the spacers 25 have been placed. The individual legs 23 are then placed on top of the bottom section 22 in step 34. The legs 23 may comprise several layers. Thus if a leg length of 4 mm is required, two layers of 2 mm material may be employed on top of the other (spacers may or may not be employed between the layers).

A further set of spacers 24 are then placed on top of each the legs 23 in step 35. As before, adhesive 25 may be applied in step 36. The top section 21 is then placed on top of the legs 23 in step 37. By appropriate selection of the position and amount of adhesive 25, the legs 23 may be adhered to the top 21 and bottom sections 22. More particularly, if the adhesive 25 is applied in a layer which is thicker than the spacers 24, pressing the top 21 and bottom 22 sections together before the adhesive 25 has cured allows the adhesive 25 to spread reducing its thickness to that of the spacers 24. Epoxy adhesives would be examples of suitable adhesives 25. This method assembly 30 of a gapped magnetic component from sections of magnetic material whereby the adhesive 25 is applied to a different area of surface than the spacers 24 allows for a reliable mechanical assembly held together by the adhesive 25 but where the thickness of the adhesive 25 is limited to be the thickness of the spacer material 24.

Whilst adhesive 25 may be employed on top of the spacers 24, the desired gap size is typically relatively thin and accordingly to ensure a consistent gap thickness, the gap is best set solely by the spacer material. The gap length is typically of the order of 10 μm to 200 μm and more preferably 20 μm to 100 μm which in turn is defined by the spacer thickness. Accordingly, it desirable that the regions on which spacers 24 are placed are distinct from those where adhesive 25 is placed. Where a spacer material is too thin, multiple layers of spacer material may be employed in a laminar fashion to obtain a thicker spacer 24. It will be appreciated that a jig may be used to assist in assembly and more particularly to ensure correct alignment of the sections. The jig may have three recesses, each for receiving a leg. The jig may have alignment features for receiving the spacers (suitably as single sheet) after which adhesive may be applied and finally a top/bottom section may be applied on top either using the same alignment features as the spacers (if shaped the same) or different ones if shaped differently. It will be appreciated that the partial assembly may then be removed from the jig (suitably once the adhesive has set) and placed in a further jig so that the remaining spacer and top/bottom section may be fixed. An alternative method of construction is to employ the spacers as discussed above but without adhesive and to hold the sections together using a clamp or similar restraint for example by wrapping the structure in tape. Although this is a less desirable method of construction as it would add to the height of the assembled component.

It will be appreciated by those skilled in the art that the electrical part of the magnetic component is also required to be assembled on a core. Whilst this may be achieved after assembly of the core, it is easily accommodated during the process of assembling the core. Thus, in the case where a bobbin is employed to hold the one or more electrical windings, the bobbin might be placed on the bottom section after/before the placement of the spacers and used to act as a guide for the placement of the legs on top of the bottom section.

Thus the bobbin may be employed to align the magnetic components and to minimise the adverse build-up of mechanical tolerances which might otherwise reduce the effective winding window width available. The bobbin may thus be provided with features for aligning with or engaging with one or more of the top, bottom and leg sections.

Prior art approaches to bobbin design have generally been relatively limited with the primary function of the bobbin being viewed as mere support onto which the windings may conveniently be wound for subsequent assembly with a core. The present application provides a novel approach to bobbin design which may be employed with the above described core constructions or indeed with any other core construction. In one form, the bobbin construction provides for an effective reduction in circuit footprint for the magnetic component by allowing the positioning of components below parts of the bobbin as will now be explained. Other advantages will become apparent from the more detailed description which follows below, including for example the provision of isolation without the need for tape or triply-insulated wire. At the same time, the design of the bobbin allows limitation of parasitic capacitive coupling and allow for design of a determined or low value of leakage inductance by modification of bobbin dimensions.

Figure 8:
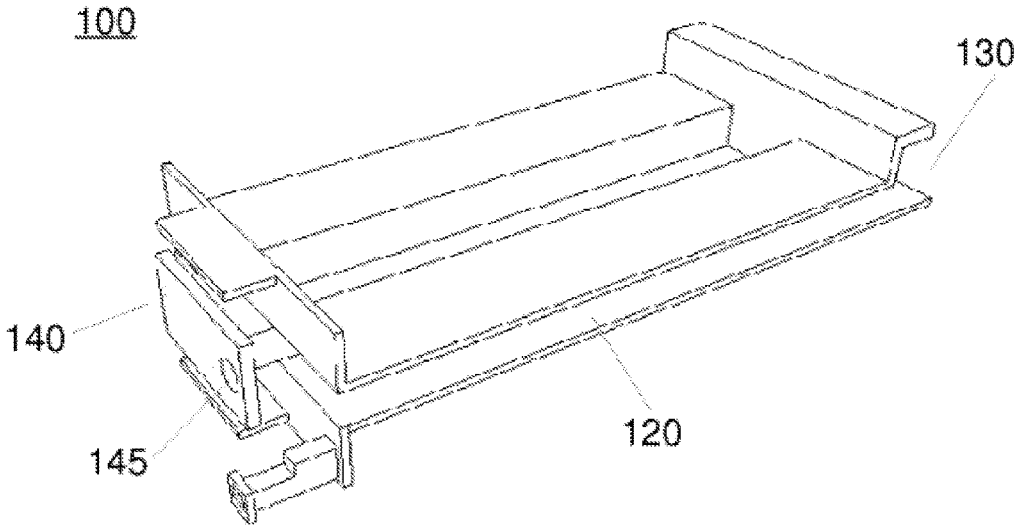
FIG. 8 is a first perspective view from the top left hand side of a bobbin for a magnetic component according to another aspect of the present application.
Figure 9:
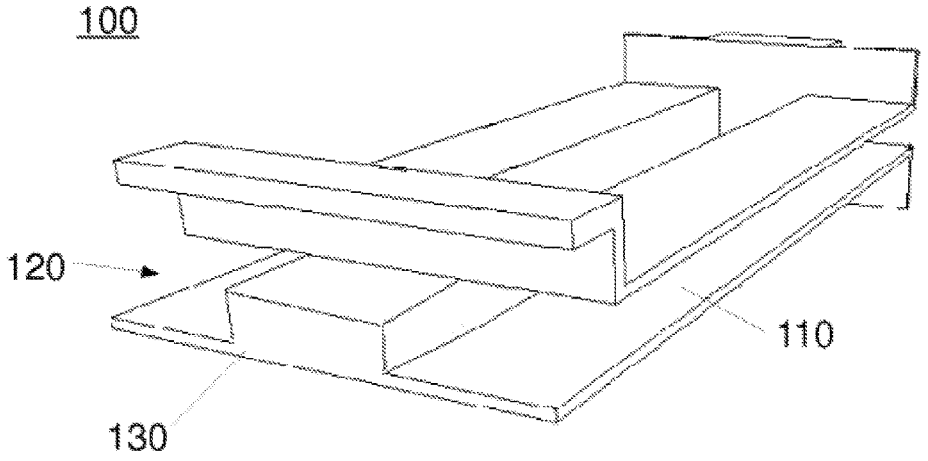
FIG. 9 is perspective view from the opposite end of FIG. 8.
Figure 10:
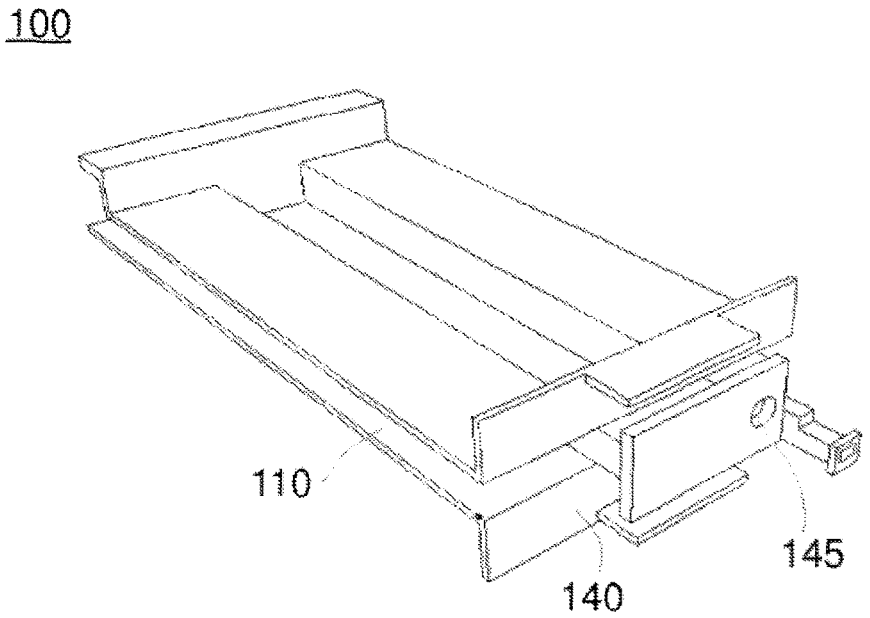
FIG. 10 is another perspective view of the bobbin of FIG. 8.
Figure 11A:
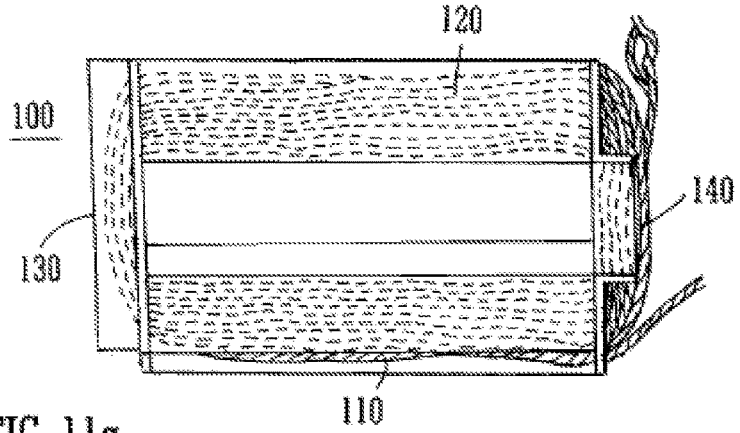
FIG. 11 is series of views of the bobbin of FIGS. 8 to 10 with a winding in place.
Figure 11B:
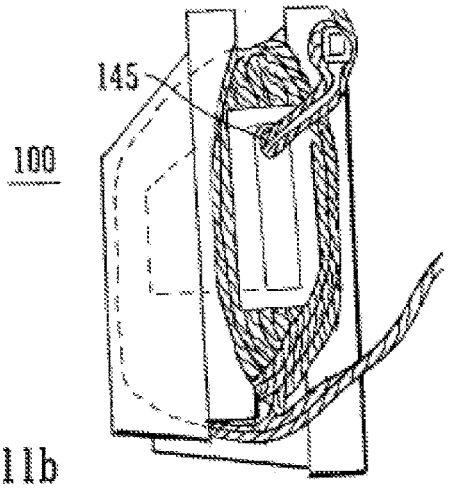
Figure 11C:
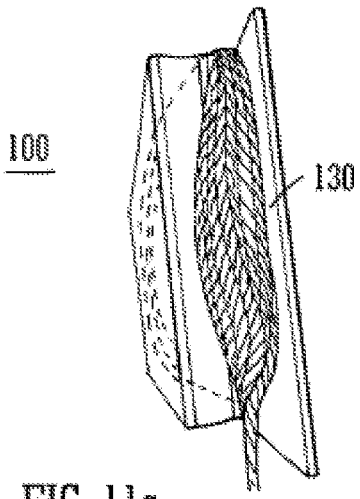
Figure 15A:
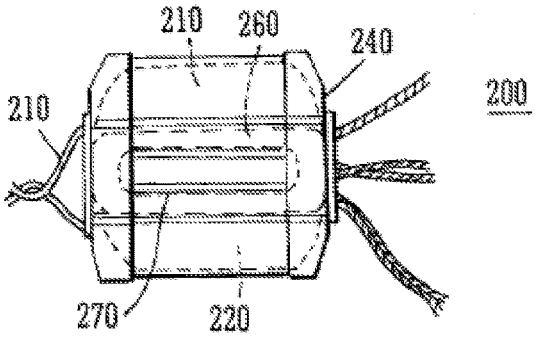
FIG. 15 illustrates a series of views of the bobbin of FIGS. 12 to 14 with windings in situ.
Figure 15B:
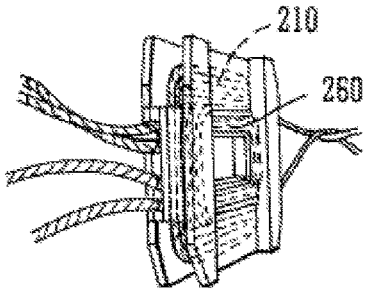
Figure 15C:
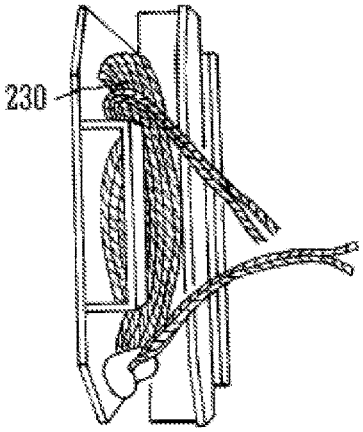
Figure 15D:
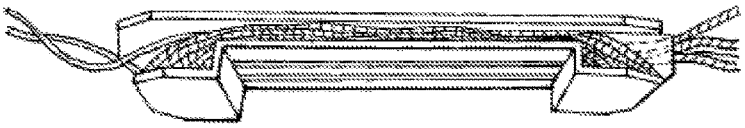
Figure 15E:
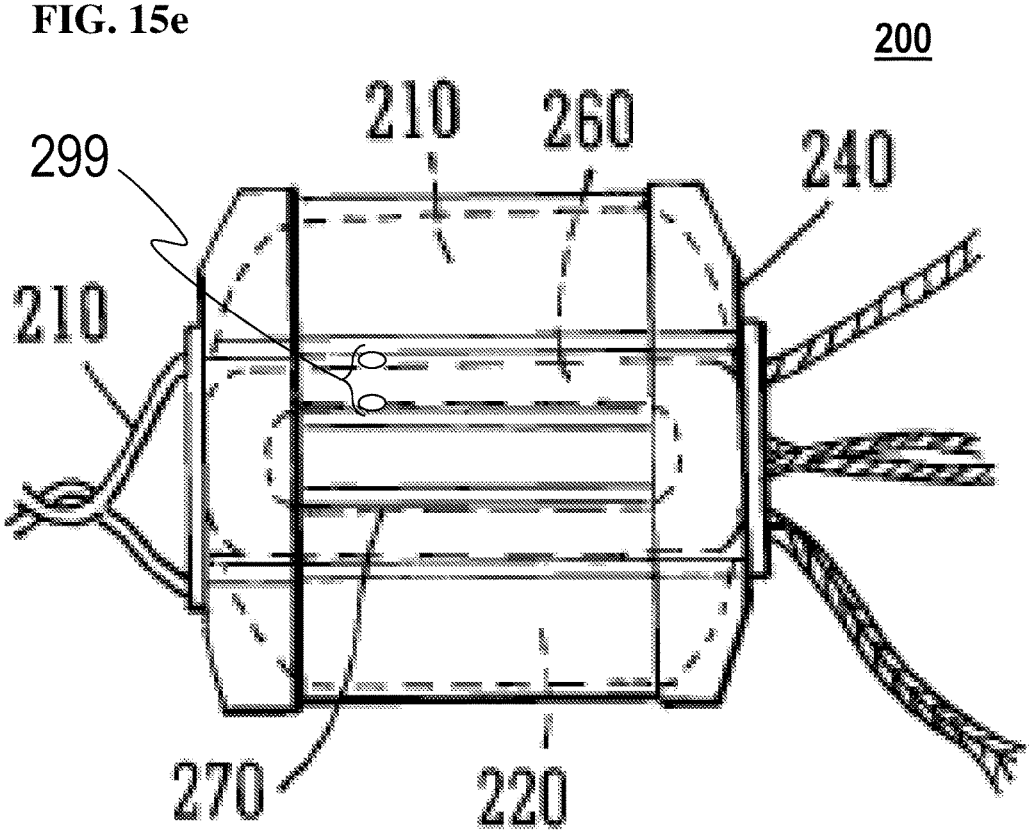
Figure 16:
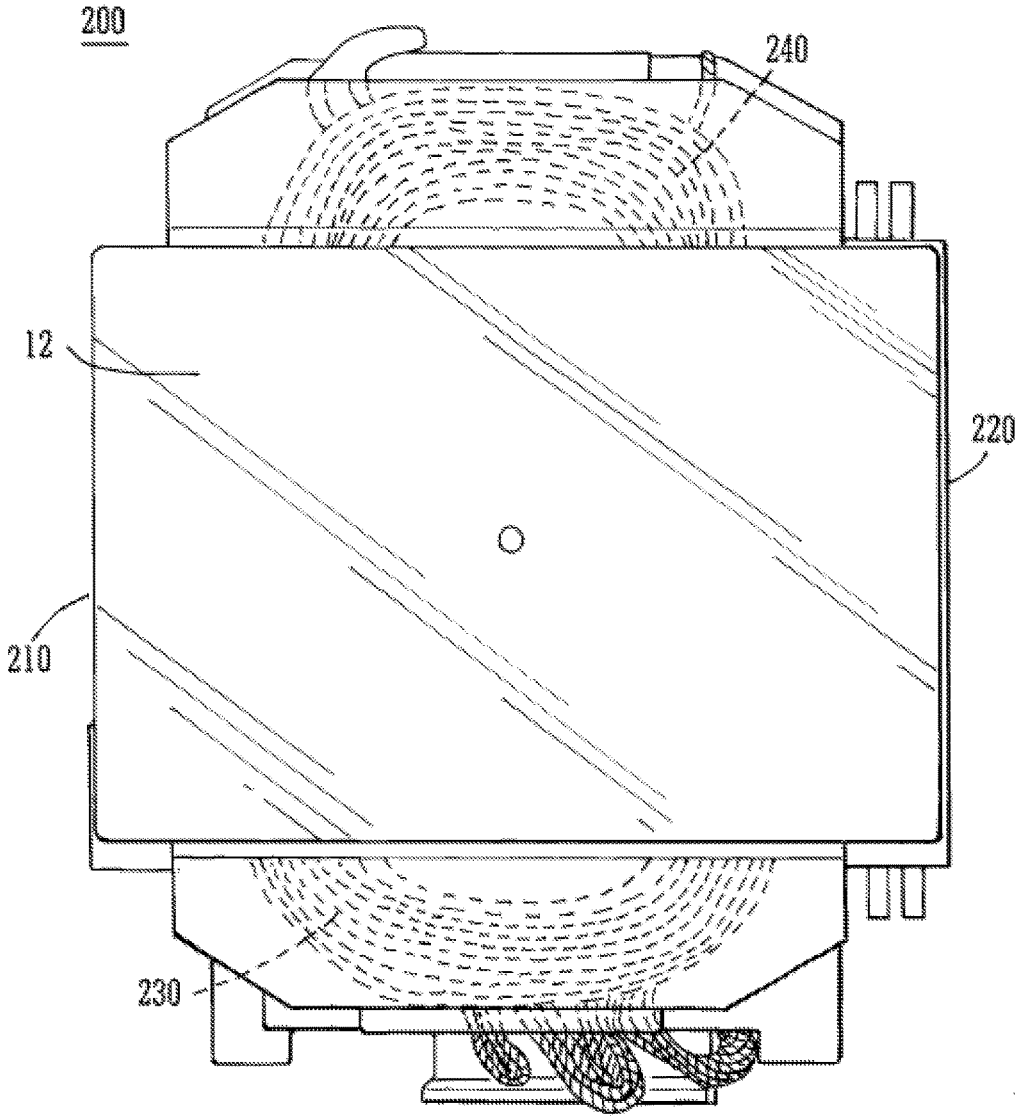
FIG. 16 illustrates an assembled bobbin and core.

An exemplary bobbin 100 will now be described which is suitable for use with the previously described three legged cores 20. The exemplary bobbin 100, shown in FIGS. 8 through 10, is intended to provide an inductor, i.e. a magnetic component with a single winding as illustrated in the views of FIG. 11 (it will be appreciated that a reference to a single winding does not mean a single turn and that a winding may have one or more turns). The bobbin 100 provides an inner wall which defines an opening for receiving the leg of a magnetic component. The bobbin 100 has six sides: a first side which in use faces the top section; a second side, opposed to the first side, which in use faces the bottom section; two opposed longitudinal sides; and two opposed transverse sides. In the exemplary bobbin 100, the inner wall comprises four inner walls defining a rectangular opening to correspond to a rectangular leg. It will be appreciated that the inner walls are suitably selected to conform to the shape of and accommodate a leg of a core. Thus other shapes are possible. A first longitudinal channel 110 is provided to the outside of the inner wall on a first longitudinal side. The first longitudinal channel 110 is defined by the exterior of the inner wall, a top surface and a bottom surface. The top and bottom surfaces are substantially perpendicular to the inner wall and extend therefrom. The first longitudinal channel 110 is dimensioned to accommodate a section of a winding. A second corresponding longitudinal channel 120 is provided on the opposite longitudinal side of the rectangular opening and accommodates a further section of the winding.

The first longitudinal channel 110 and the second longitudinal channel 120 are coplanar as would be found generally in the art, i.e. windings are generally wound concentrically around a bobbin and a section of winding on one side of a core is matched by a section of winding on the opposite side of the core.

However, in contrast to the art, the bobbin 100 of the present application provides a first transverse path 130 extending from the first longitudinal channel 110 to the second longitudinal channel 120 along a first transverse side which is not coplanar with the channels 110, 120. This first transverse path 130 comprises the inner wall and a top and bottom surface. The bottom and top surface of the transverse path 130 are raised up relative to the top and bottom surfaces of the longitudinal channels 110, 120. In the exemplary bobbin illustrated 100, the bottom surface of the transverse path is level with the top surfaces of the longitudinal channels. Thus the winding is raised up and falls back down as it crosses over from side to the other. This raising or splaying of the windings means that the space required by the windings at either end is reduced since the windings are bent/splayed either up or down thus spreading the windings in the vertical as well as horizontal planes. Thus, where 4 mm of space might be required in a conventional bobbin for the windings at either end, in the exemplary bobbin 100 this figure might be reduced to closer to 2 mm. As a result the overall footprint of the bobbin/magnetic component is reduced. In the exemplary construction illustrated, the first transverse path 130 may be considered to be split with the first path as previously described and in effect providing a raised transverse path, whilst at the same time a lowered transverse path 140 is provided below the first path. Splitting the transverse path 130 into an upper 131 and a lower 132 transverse path effectively provides for a further reduction in size.

At the opposite transverse side to the first transverse path 130, a second transverse path 140 may be provided. It will be appreciated that if the winding comprises a single turn there is no requirement as such for the second transverse path 140. Equally, the second transverse path 140 need not be raised as the terminations of the windings may be made here. However, there is benefit by raising the winding at both ends. In particular, the second transverse path 140 is defined as with the first transverse path 130 by an exterior side of the inner wall a top surface and a bottom surface and an outer wall. An aperture 145 is provided in the outer wall which provides a feed point for the inner part of the winding which as will be appreciated by those skilled in the art generally has to be accommodated as a winding generally wraps around itself. However by splaying the coil, a space is created. Whilst the inner wall accommodates the leg of a core, the wall may extend upwards and downwards at the first 130 and second 140 transverse to accommodate top 22 and bottom 23 sections of the core 20. Isolation walls may be provided as part of the bobbin 100 to isolate the winding from other parts of the circuit. Similarly, one or more features may be provided on the bobbin to facilitate easy termination of the winding. These features may be formed as part of one piece bobbin construction for example using a plastics material or they may be additional pieces formed with the plastics material for example metal pins for terminating the winding and facilitating placement on a circuit board as a PTH or SMT component.

A further exemplary bobbin construction 200, shown in FIGS. 12 to 14 provides a former for first and second windings (as shown in FIG. 15) with isolation between the windings provided by the bobbin structure. This further bobbin construction 200 is similar to the first 100 but additionally provides a first longitudinal passage 260 positioned between the inner wall and the first longitudinal channel 210. A second longitudinal passage 270 is positioned provided between the inner wall and the second longitudinal channel 220. The passages are enclosed by the bobbin material so that an isolation barrier is provided between the longitudinal passages 260, 270 and the longitudinal channels 210, 220. At the same time the space created by raising the transverse paths (as discussed above with reference to the first bobbin construction) is used in this construction to provide openings allowing access to the longitudinal passages 260, 270. In this way a winding (or a turn thereof) may be fed through a first opening at a first transverse end and through the first longitudinal passage 260 and out an opening at the opposite transverse end. Once out, the winding may be passed back through the second longitudinal passage 270 via an isolated transverse passage and out the first transverse end thus effecting a turn. The isolated transverse passage is isolated from the transverse path at the opposite transverse end. Once the turn is completed, the opposite (closed) end of the turn may be pulled back into the bobbin until it meets the inner wall, thereby providing an isolation gap to the outside of the bobbin. The process may be repeated if multiple turns are required. It will be appreciated that the winding passing within the longitudinal channels (typically the primary winding of the transformer) may be readily terminated at an opposing transverse end of the bobbin 200 to that of the winding passing within the longitudinal passages (typically the secondary winding of the transformer) thereby ensuring isolation is maintained. It will be appreciated that there is no need for special insulation on the windings to isolate the secondary from the primary as the bobbin walls provide inherent isolation. Walls may be added as required to improve creepage distances to meet particular design or safety requirements.

As shown in FIG. 15, a plurality of windings can be provided within the longitudinal channels. This allows for these windings of the transformer to be tapped, as the windings longitudinal channels can be connected together to allow a user to select between different numbers of turns. Similarly, a plurality of windings can be provided within the longitudinal passages. This allows for these windings of the transformer to be tapped, as the windings can be connected together to allow a user to select between different numbers of turns. This means the transformer has a variable turns ratio, enabling voltage regulation of the output.

Additionally, because a significant number of the coil parameters are defined by the dimensions of the bobbin, it is possible to produce more predictable magnetic components. Thus a component designer may choose to alter wall thicknesses (for example that of the inner wall) to meet a particular requirement. Equally, whilst the previously described passageways are suitably dimensioned to receive a primary winding comfortably such that there is limited difficulty in feeding the winding through, the component designer may oversize these passageways to provide for greater leakage inductance by increasing the spacing. Where this is employed, one or more spacers such as hollow beads or a filler may be employed to restrict movement of the winding and to keep it in a predefined position within the passageways. For example, the winding can be kept centrally positioned in the passageways.

Thus it will be appreciated that a bobbin for a magnetic component is provided for two windings. The bobbin provides first and second concentric paths for the first and second windings respectively about a leg of a core. The bobbin provides openings at opposing ends of the bobbin to allow feeding of the first winding about the first concentric path. The second concentric path is around the first in one direction and above the first in a second direction transverse to the first. It will be appreciated that whilst the bobbin has been described in the context of having openings for receiving and feeding the inner winding, that the winding may be integrally formed as part of the bobbin during the bobbin manufacturing process. For example, where the bobbin is formed using a plastics injection molding process, the inner winding may be integrally formed as part of this process, i.e. overmolded. Although, it will be appreciated that this removes the flexibility of changing the inner windings to meet particular requirements.

Figure 17:
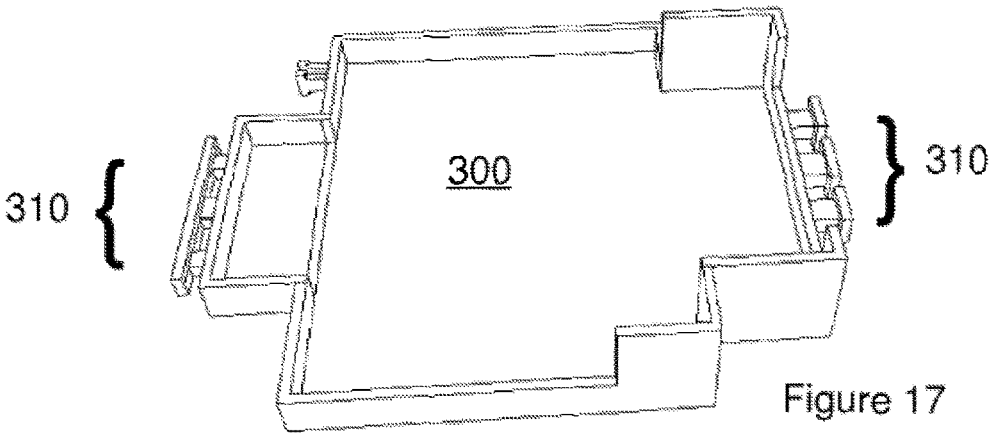
FIG. 17 illustrates an exemplary tray which may be employed with a bobbin or core according to a further aspect.

A further feature which may be employed with either the bobbins 100, 200 or cores 20 or both is a tray for receiving a magnetic component. An exemplary tray is shown in FIG. 17. The tray 300 is formed from an insulating material such as a plastic. The tray is sized to accept the core 20 and provides a barrier between the magnetic core 20 and the underlying circuit board on which the tray 300 is placed. One or more wiring termination posts 310 may be provided on the tray to facilitate termination of windings from the transformer. A termination post may provide a metal contact which may be employed as a SMT or PTH lead. The tray 300 may be fixed to the magnetic component by an adhesive or the magnetic component may be held in place by a snap fit or similar locking feature.

The above bobbin 200 has been described as a single piece construction formed using a suitable insulating material with the passageways illustrated and described as enclosed, they are not necessarily so. Thus the bottom may be open allowing for the insertion of the winding. It will be appreciated that in such a construction, it is not necessary to provide openings at both ends as there is no need to feed the wire back during assembly as such. However, this construction would generally not be practicable because of the need to ensure sufficient creepage to the surrounding magnetics.

The above method of constructing a bobbin in which the wire is fed through passageways is not restricted to a concentric bobbin construction. The passageways may be used in other bobbin constructions.

Thus for example, a multi layer (split) bobbin may be provided having a first winding layer defining a first region around an inner wall on which a first winding may be wound. The first region may be further defined by its placement between a top wall and a separating wall. An inner wall defines a space in which a magnetic core may be placed, e.g. the center leg of a three leg core. The first region is open and so the first winding may be wound using a conventional bobbin winding machine or by hand. To facilitate this winding the bobbin is open, i.e. there are no enclosed passages of the type previously described. A second winding layer may be provided below the first layer and separated by a seperating wall. The separating wall extends outward from and is transverse to the inner wall. A bottom wall may be provided on the opposite end of the bobbin to the separating wall. The second winding layer comprises passages generally of the type previously described and so a winding may not be conventionally wound around the inner wall but instead must be fed into a first opening along one passage way, out a second opening at the opposite side and fed back through a second passageway to first opening. The second opening may be recessed so as to increase creepage distance as was described previously. The passageways are suitably formed by one or more outer walls (e.g. two on opposing sides), in combination with the inner wall, separating wall and bottom wall. The net result is that the second region is at least partially enclosed by the one or more outer walls concentric to the inner wall. The outer walls isolate and provided enhanced creepage between a winding in the second region and any surrounding magnetic core material. It will be appreciated that as the second region is enclosed, a winding may not be wound directly about the inner wall in the second region and the openings must instead be employed to feed the winding about the inner wall.

The constructions described herein are not limited to a single second winding and there may be multiple secondary windings.

Similarly, whilst the passageways generally herein for all embodiments have been described in the context of providing a secondary output (i.e. with a lower voltage output and hence number of turns than the primary output), they are not restricted to such a use. Thus, for example a sense winding may be would using the passageway indeed any winding may be so wound, the only requirement is that the winding be a single turn or relatively small number of turns as each turn must be fed through the passageway. Additionally, multiple windings may be provided together, thus two secondary windings may be co-wound. Similarly, a sense winding may be would with a secondary winding although in this configuration it will be appreciated that since the sense winding would generally be employed on the primary side that it should be insulated wire. At the same time, it would be preferable for creepage requirements that the sense winding come out at the opposite end of the bobbin to the secondary winding.

The bobbin and core constructions described herein are ideally suited to use in higher frequency switching converters of the type where the switching frequency is over 100 kHz.

It will be appreciated that whilst the bobbins described herein have been described in the context in which the windings are would on the bobbins and termination is to a post or the underlying circuit board that the constructions are no so limited. For example, the bobbins may be formed with integral PTH or SMT connections features moulded with the bobbin and for connecting to an underlying circuit board. The connection features suitably have a simple manner by which they may be connected to a winding. For example, the connection feature may provide a crimp, cleat, spring clamp, grip fit or friction fit type connection into which the wire of a winding may be pushed and then cut.

It will be appreciated that all of the various bobbin constructions may be used with any of the magnetics constructions and vice versa to produce a compact low profile magnetic component and indeed all of such combinations are readily contemplated.

One of the advantages of the core construction described herein is that it minimises the risk of the transformer producing audible noise. The reason for this is that the adhesive material in the gaps dampens vibration. At the same time, the legs are formed from thin (relative to their cross sectional dimensions) pieces of laminar magnetic material and so the legs are less prone to vibrations than the legs of a conventional E-core where the legs would be relatively thick with respect to their cross sectional dimensions. Whilst, the above application has been described generally in the context of a three legged core and a bobbin for such, it will be understood, that whilst this is the preferred approach, that it is also possible to apply the techniques to a two legged core of the type which would generally be constructed using a C or U shaped core in combination with an I shaped core. It will be appreciated that in such a construction, the core may be constructed using the laminar sections for top and bottom sections with smaller laminar sections for the two legs. The adhesive and spacer combination previously described may be employed to provide a gap between each of the legs and each of the respective top and bottom sections. This effectively produces a magnetic core in which the gap is distributed across four separate gaps and at the same time is kept away from the windings.

The words comprises/comprising when used in this specification are to specify the presence of stated features, integers, steps or components but does not preclude the presence or addition of one or more other features, integers, steps, components or groups thereof.

The invention claimed is:

1. A transformer comprising:

a bobbin having a structure and an opening;

a three legged magnetic core having a middle leg passing through the bobbin opening;

a first winding provided in a first concentric path around a point in the middle leg of the magnetic core, wherein the first concentric path includes at least two segments in a first plane that passes through the middle leg of the magnetic core;

a second winding provided in a second concentric path around the point in the middle leg of the magnetic core, wherein the second concentric path includes at least two segments in the first plane and at least one segment outside of the first plane, wherein the first and second concentric paths are isolated from each other by the structure of the bobbin, wherein the first concentric path comprises a first longitudinal passage having a first longitudinal axis, and a second longitudinal passage having a second longitudinal axis, wherein the first longitudinal passage is enclosed along the first longitudinal axis by the structure of the bobbin, wherein the second longitudinal passage is enclosed along the second longitudinal axis by the structure of the bobbin, wherein, at a start point of the first concentric path, the first winding enters the bobbin through a first opening to the first longitudinal passage at a first end and exits through a second opening provided at a second end, opposite the first end, wherein the first winding is fed back through the second longitudinal passage to return toward the start point of the first concentric path, and wherein each of the first and second longitudinal passages is positioned between the second concentric path and the middle leg of the magnetic core.

2. The transformer according to claim 1, wherein the second winding comprises a single turn.

3. The transformer according to claim 1, wherein the second winding is formed using Litz wire.

4. The transformer according to claim 1, further comprising a spacer provided to maintain the first winding in a predefined position in one of the longitudinal passages.

5. The transformer according to claim 1, wherein the three legged magnetic core further comprises:

a top section;

a bottom section;

with two further legs in addition to the middle leg;

wherein there is a gap defined between each leg and the top section and a gap defined between each leg and the bottom section.

6. The transformer according to claim 5, wherein each defined gap has a gap length of between 10 μm and 200 μm.

7. The transformer according to claim 6, further comprising a spacer provided in each gap to define the gap length.

8. The transformer according to claim 7, further comprising adhesive provided in the gaps.

9. The transformer according to claim 1, further comprising a tray for the transformer, the tray providing one or more PTH connections for connecting to an underlying circuit board.

10. The transformer according to claim 1, further comprising a tray for the transformer, the tray providing one or more SMT connections for connecting to an underlying circuit board.

11. An apparatus comprising:

a bobbin for a transformer, the bobbin having a structure and defining an opening for receiving a leg of a magnetic core, the bobbin being arranged to receive a first winding in a first concentric path around a point in the opening, wherein the first concentric path includes at least two segments in a first plane that passes through the opening, the bobbin being further arranged to receive a second winding in a second concentric path around the point in the opening, wherein the second concentric path includes at least two segments in the first plane and at least one segment outside of the first plane, wherein the first and second concentric paths are isolated from each other by the structure of the bobbin, and wherein the first concentric path includes:

a first enclosed longitudinal passage provided along a first side of the opening for receiving the leg of the magnetic core and having a first opening at a first end of the first enclosed longitudinal passage and a second opening opposite the first end of the first enclosed longitudinal passage, wherein the first enclosed longitudinal passage has a longitudinal axis, and a second enclosed longitudinal passage provided along a second side of the opening for receiving the leg of the magnetic core which is opposite the first side and having a third opening at a first end of the second enclosed longitudinal passage and a fourth opening opposite the third end of the second enclosed longitudinal passage to allow feeding of the first winding about the first concentric path through the first opening, second opening, third opening and fourth opening, wherein the second enclosed longitudinal passage has a longitudinal axis.

12. The apparatus according to claim 11, wherein the first opening and second openings are co-axial with the longitudinal axis of the first enclosed longitudinal passage.

13. The apparatus according to claim 11, wherein the third opening and fourth openings are co-axial with the longitudinal axis of the second enclosed longitudinal passage.

14. The apparatus according to claim 11, wherein the bobbin includes an inner wall transverse to and between the second opening and third openings, wherein the inner wall is provided in a recess defined in the bobbin.

15. The apparatus according to claim 11, wherein the bobbin is a single piece construction.

16. The apparatus according to claim 11, wherein the apparatus further includes one or more PTH connections for connecting to an underlying circuit board.

17. The apparatus according to claim 11, wherein the apparatus further includes one or more SMT connections for connecting to an underlying circuit board.

18. The apparatus of claim 11, further comprising:

the magnetic core;

the first winding in the first concentric path around the opening; and the second winding in the second concentric path around the opening.

19. An apparatus comprising:

a gapped magnetic core that includes a plurality of legs including a first leg, a second leg, and a third leg, a top section, and a bottom section, wherein the top section, the bottom section and each one of the plurality of legs includes a laminar piece of ferrite magnetic material provided as a flat plate, wherein there is a gap defined between each leg of the plurality of legs and the bottom section, and wherein there is a gap having a gap length defined between each leg of the plurality of legs and the top section;

a spacer included in each defined gap to define the gap length;

a bobbin having a structure and an opening;

a first winding provided in a first concentric path around a point in the second leg of the magnetic core, wherein the first concentric path includes at least two segments in a first plane that passes through the second leg of the magnetic core; and a second winding provided in a second concentric path around the point in the second leg of the magnetic core, wherein the second concentric path includes at least two segments in the first plane and at least one segment outside of the first plane, wherein the first and second concentric paths are isolated from each other by the structure of the bobbin, and wherein each defined gap has a gap length of between 10 μm and 200 μm.

20. The apparatus of claim 19, wherein the bobbin is a single piece construction.

* * * * *